US006652215B1

(12) United States Patent
Parker et al.

(10) Patent No.: US 6,652,215 B1
(45) Date of Patent: Nov. 25, 2003

(54) ROTARY DEBLISTERING APPARATUS

(75) Inventors: Andrew Ernest Parker, Newtownards (GB); Aaron Hewitt, Newtownards (GB); Andrew Davidson, Newtownards (GB)

(73) Assignee: Sepha Pharmaceutical, Newtownards (GB)

( * ) Notice: Subject to any disclaimer, the term of this patent is extended or adjusted under 35 U.S.C. 154(b) by 0 days.

(21) Appl. No.: 09/831,231

(22) PCT Filed: Nov. 2, 1999

(86) PCT No.: PCT/GB99/03618

§ 371 (c)(1),
(2), (4) Date: Aug. 13, 2001

(87) PCT Pub. No.: WO00/27709

PCT Pub. Date: May 18, 2000

(30) Foreign Application Priority Data

Nov. 5, 1998 (GB) ..... 9824096
Mar. 19, 1999 (GB) ..... 9906232

(51) Int. Cl.[7] ..... B65B 69/00

(52) U.S. Cl. ..... 414/412; 198/483.1; 221/31; 414/222.13; 414/226.01; 414/811

(58) Field of Search ..... 414/222.13, 226.01, 414/412, 416.1, 811, 797.4, 798.1; 198/471.1, 483.1; 221/31; 53/381.2

(56) References Cited

U.S. PATENT DOCUMENTS 2,366,886 A * 1/1945 Van Tuyl ..... 206/3
2,431,320 A 11/1947 Fischer ..... 214/1.1
3,802,547 A * 4/1974 Wagers et al. ..... 198/411
4,428,709 A * 1/1984 Peters ..... 128/203.15
4,909,412 A * 3/1990 Cerf ..... 221/1
4,950,120 A * 8/1990 Barnes ..... 221/222
4,975,015 A * 12/1990 Harding ..... 206/532
4,988,255 A * 1/1991 Hoffman ..... 414/412
5,254,164 A * 10/1993 Masahumi ..... 118/319
5,342,160 A * 8/1994 Nakajima ..... 414/412
5,415,321 A * 5/1995 Gehlert et al. ..... 221/200
5,509,773 A * 4/1996 Connor et al. ..... 414/412

FOREIGN PATENT DOCUMENTS

DE 29 37 255 4/1980 ..... B65G/65/02
DE 296 16 341 1/1998 ..... B65B/69/00
EP 0059638 A1 * 9/1982
EP 0401698 A2 * 12/1990
GB 2067155 A * 7/1981

* cited by examiner

*Primary Examiner*—James W. Keenan
(74) *Attorney, Agent, or Firm*—Moser, Patterson & Sheridan, L.L.P.

(57) ABSTRACT

A rotary deblistering apparatus is described. It comprises a rotatable drum having plurality of circumferential pack holding means each adapted to hold and retain a blister pack. The drum can rotate to locate the pack holding means at a plurality of peripheral work positions including a pack loading position, a pack deblistering position, and a pack detachment position. The blister packs can be loaded onto the drum through a loading means, preferably the loading means has a storage magazine able to supply a continuous number of packs to the drum. For a peelable pack, prior weakening or cutting of the backing of the pack may be necessary or desired. Such action could be carried out at the pack deblistering position. Alternatively, there is a prior weakening and/or cutting position around the drum.

18 Claims, 6 Drawing Sheets

POSITION 1

POSITION 2

26
28
29
30
31
32a
32b
34

ROTARY DEBLISTERING APPARATUS

CROSS REFERENCE TO RELATED APPLICATIONS

This Application is the U.S. National Phase Application of PCT International Application No. PCT/GB99/03618 filed Nov. 02, 1999, and published under PCT Article 21(2) in English.

The present invention relates to a rotary deblistering apparatus.

DESCRIPTION OF RELATED ART

Blister packs for pharmaceutical tablets are generally either "push through" packs, where manual pushing of the tablet will eject it from the pack through the backing, or "peelable" packs. Peelable packs are intended to be child-resistant, and require the backing to be 'peeled' away before the tablet is accessible. Deblistering of tablets from a push through pack is generally carried out by passing the packs through rollers. Because of the more sealed nature of the peelable pack, deblistering of tablets from such packs is often not possible simply through rollers, and linear or batch processing has been necessary.

BRIEF SUMMARY OF THE INVENTION

According to one aspect of the present invention, there is provided a rotary deblistering apparatus comprising a rotatable drum having a plurality of circumferential pack holding means, each adapted to hold a blister pack, wherein the drum is rotated to locate the pack holding means at a plurality of peripheral work positions including a pack loading position, a pack deblistering position, and a pack detachment position.

The multiplicity of pack holding means on the drum, and the drum's rotational ability, allow more than one pack to be handled at the same time, increasing the rate of deblistering of the apparatus compared with prior art static deblistering apparatus. Indeed, the present invention is able to provide a continuous operation.

The rotational movement of the drum is preferably indexed, and the drum is preferably stationary at each work position.

The drum may have any number of pack holding means, and be of any suitable size and shape. In one embodiment of the present invention, the drum has the same or similar number of pack holding means as work positions around the drum.

Preferably, the drum is vertically arranged. More preferably, the pack loading position is located wholly or substantially above the drum, to allow gravity to assist loading of a blister pack onto the drum. Similarly, preferably the pack deblistering position and/or the pack detachment position are located wholly or substantially below the drum, to allow gravity to assist the ejection or detachment of the tablets and/or deblistered pack from the drum.

The blister packs can be loaded onto the drum through any suitable loading means. The loading means preferably has a storage magazine able to supply a continuous number of packs to the drum. The loading means could also have a pack selection means to assist individual loading of each pack onto each pack-holding means. The magazine and/or pack selection means is preferably able to deal with curled packs, which are often the most problematic with prior art deblistering apparatus. The pack selection means preferably involves opposing means moveable between pack-edge support and release positions, generally through reciprocal linear and/or rotational motion. Such means include pins, flanges, discs, etc.

A blister pack can be held by a pack holding means using any suitable attachment means, including vacuum, mechanical fastening aids, and/or possibly simple friction fit.

The pack holding means are preferably adapted to match the shape, size and configuration of the design of the pack to be deblistered. The drum also preferably allows each pack holding means to be rapidly and easily changed for different pack designs. The changeability is preferably tool-less, i.e. possible without the need for use of any separate tools such as spanners, keys, screwdrivers, etc.

The deblistering of the tablets from a pack held on the drum can be carried out using suitable mechanical or pneumatic force, eg air, pins, etc. Direct force is generally sufficient for deblistering a push through pack. For a peelable pack, prior weakening or cutting of the backing of the pack may be necessary or desired. Such action could be carried out at the pack deblistering position. Alternatively, there is a prior weakening and/or cutting position around the drum. Such a position could be permanently located, but by-passable or inoperable when the present invention is being used for push through packs.

The pack holding means may be moveable at one or more the work positions to effect the operation on the pack thereat. Alternatively, one or more of the relevant operative means at each work position is moveable when operating on the pack held on the drum.

The present invention may be used for any shape, size and design of blister pack.

According to a second aspect of the present invention, there is provided a method of deblistering one or more blister packs using a rotary deblistering apparatus as herein described, wherein the pack is loaded onto a pack holding means at the pack loading position, rotated to the pack deblistering position where the tablets are forced out of the pack, and the empty pack is then rotated to the pack detachment position where the pack is detached from the pack holding means.

In one embodiment of the method-of the present Invention, the backing of the pack is wholly or substantially cut or weakened at a further work position around the drum.

DESCRIPTION OF THE SEVERAL VIEWS OF THE DRAWINGS

An embodiment of the present invention will now be described by way of example only and with reference to the accompanying drawings in which.

DETAILED DESCRIPTION OF THE INVENTION

Figure 1:
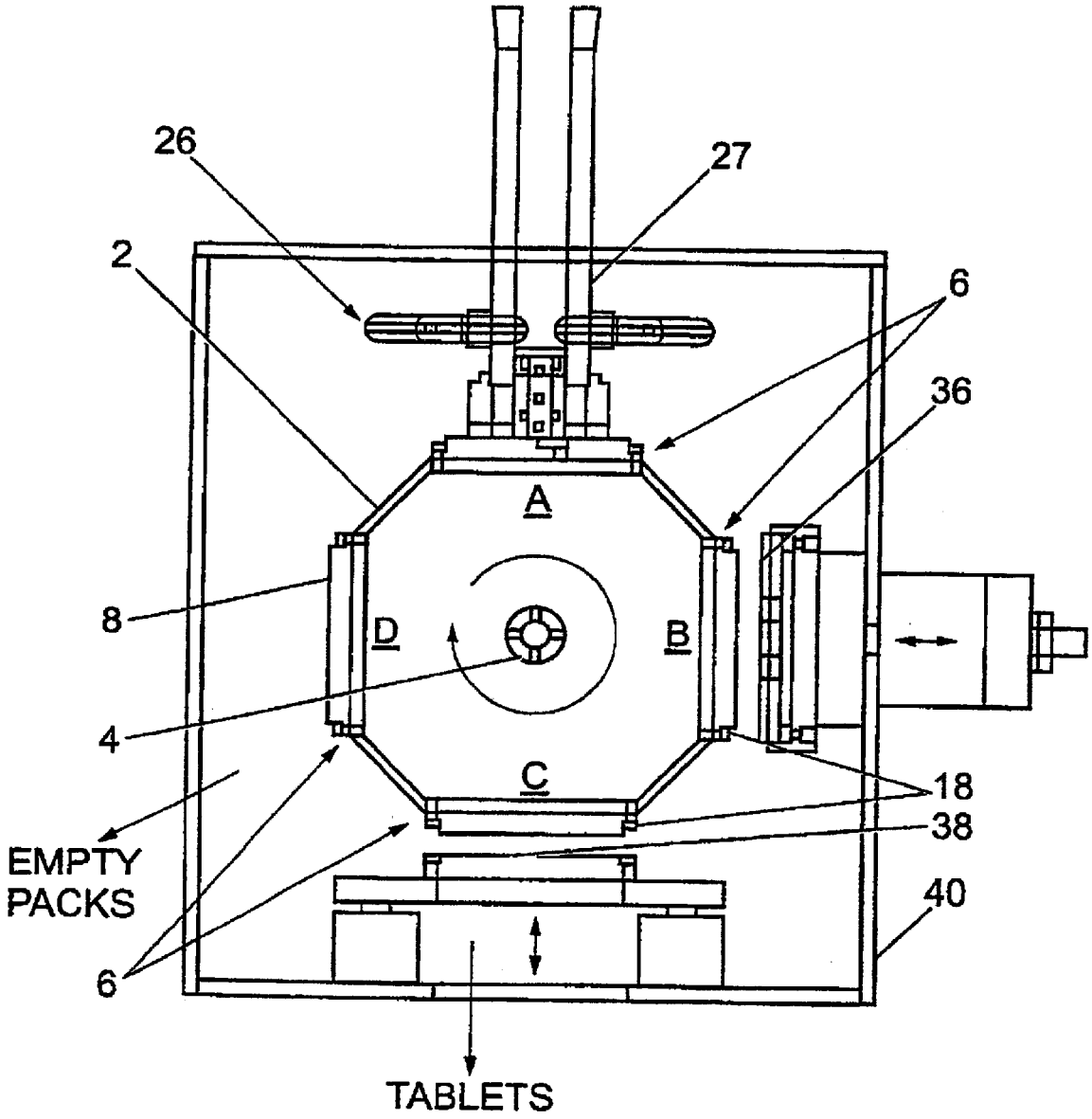
FIG. 1 is a front view of a rotary deblistering apparatus according to the present invention.
Figure 2:
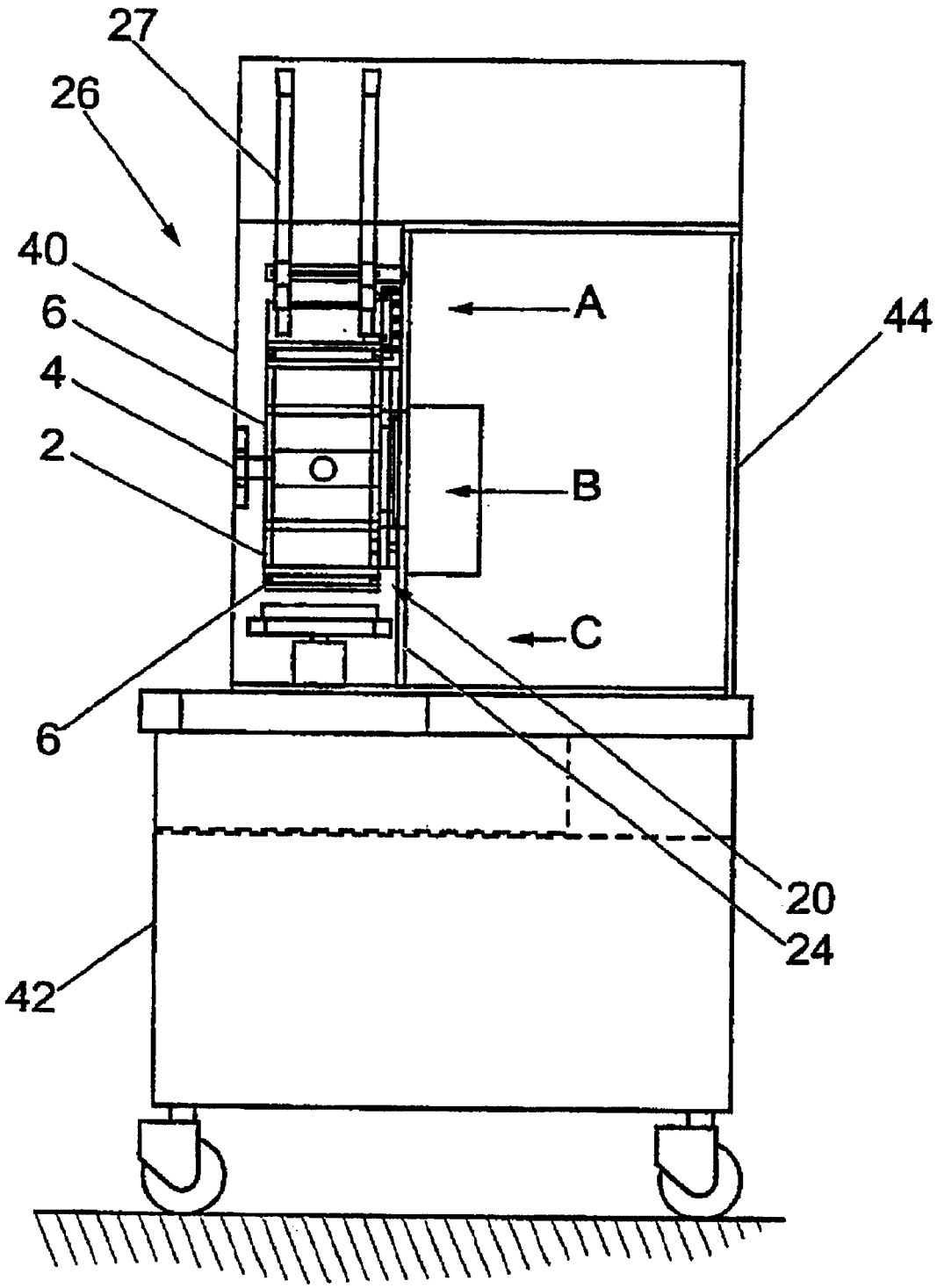
FIG. 2 is a side view of the apparatus of FIG. 1.

Referring to the drawings, FIGS. 1 and 2 show a rotary deblistering apparatus involving a drum 2 rotatable about a central axle 4. The drum 2 has four pack holding means 6 symmetrically located about its circumference.

Figure 3:
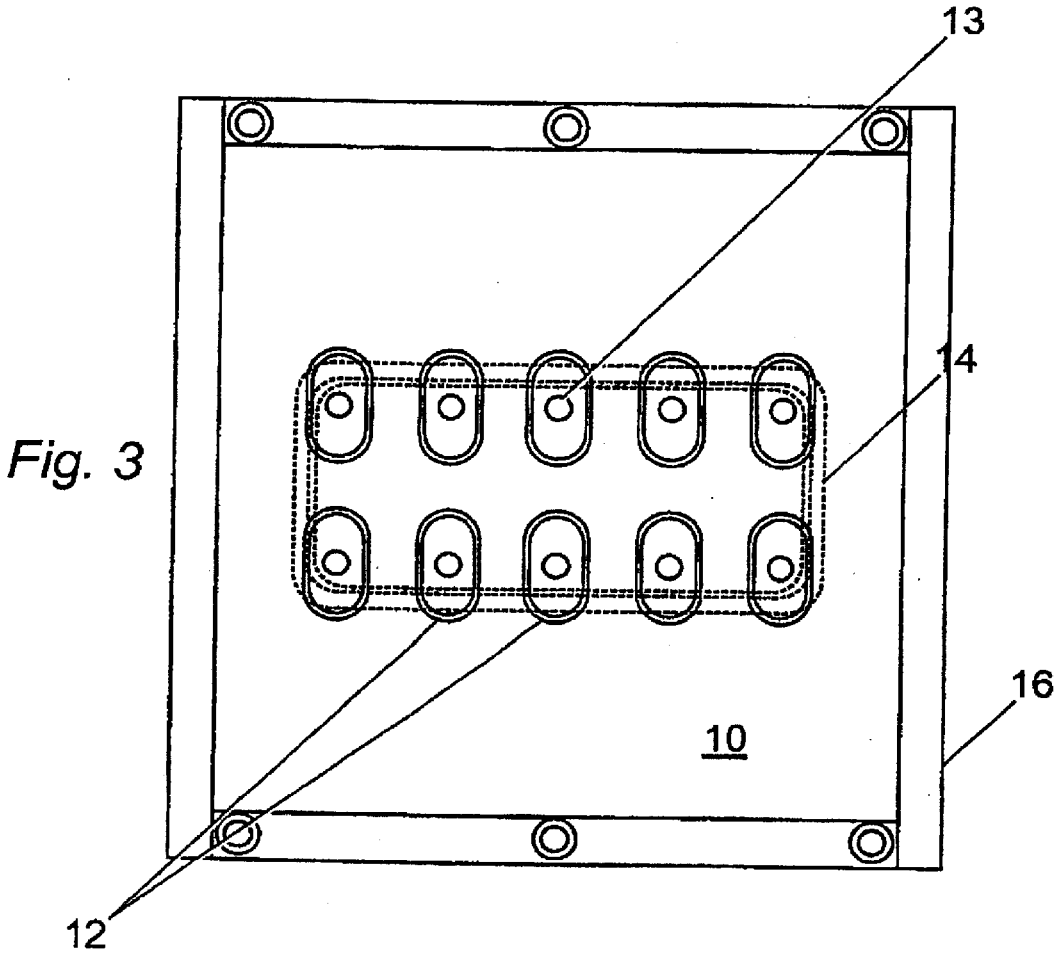
FIG. 3 is a top view of a first pack plate used in the apparatus of FIG. 1.
Figure 4:
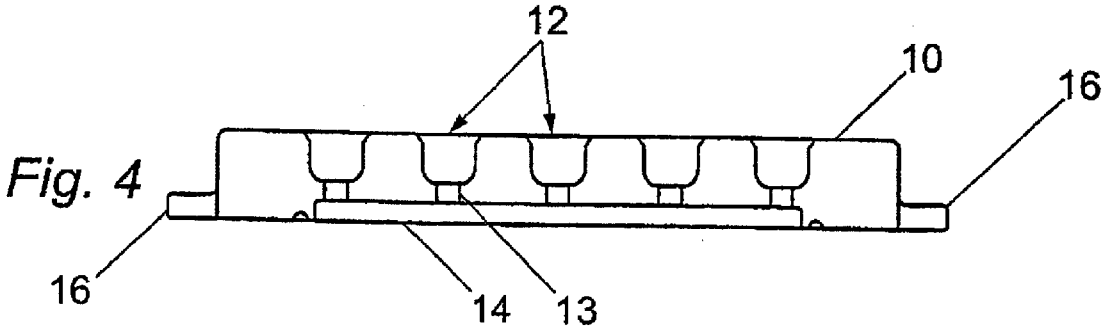
FIG. 4 is a cross-sectional side view of the pack plate of FIG. 3.

Each pack holding means 6 has a pack plate 8 which is shown in more detail in FIGS. 3 and 4. The plate 8 has a flat top surface 10 and a number of pockets 12 depending therefrom. The shape, number and configuration of the pockets 12 is designed to match the shape, number and configuration of the blisters on the blister pack or packs to be deblistered. An aperture 13 extends from the bottom of each pocket 12 and through the plate B to a hollow insert 14 in the base of the pack plate 8.

Behind each pack holding means 6 is piping (not shown) extending back to intermediate slip plates 20 between the rotating drum 2 and a stationery support wall 24. The slip plates 20 are preferably plastic, and may be urged or biased together to maintain an air seal therebetween despite wear.

Using grooves and apertures in the slip plates 20, either an air vacuum or an air over-pressure can be directed through each piping to the base of each pack plate 8 and then to the pockets 12. One or more bleed or pressure valves may be necessary around the apparatus to ensure equilibrium of pressure or vacuum, or to at least avoid over-pressure or over-vacuum. The pressure or vacuum can be supplied by any suitable pump means known in the art.

The pack plate 8 has, a shoe 16 on each side to match opposing shoulders 18 attached to the drum 2 at each pack holding location. Thus, if it is desired to deblister a pack having a different blister shape, the pack plates 8 can be rapidly and easily removed onto and off the drum 2 using a simple sliding action to fit new plates with the required new pocket shape, etc. A final fastening means could be used to hold each pack plate 8 securely on the drum 2. The base of each type of pack plate should be similar.

The rotational movement of the drum 2 is indexed, such that the drum 2 is stationery when the pack-holding means 6 are aligned with the following work positions.

In the apparatus shown in FIGS. 1 and 2, there are four work positions. Uppermost is a pack loading position A. On the right in FIG. 1 is a pack cutting position B. Lower most is a pack deblistering position C, and on the left in FIG. 1 is a pack detachment position D.

The pack loading position A involves a pack loading means 26 with an upright magazine 27 in which a number of blister packs could be stacked, either prior to operation of the drum 2 or continuously. The operation at the base of the pack loading means 26 is shown in more detail in FIGS. 5*a–d*.

FIGS. 5*a*–5*d* show a pack selection means 26 comprising opposing pack edge semi-circular blades 28. The blades a 28 are rotatable about axes 29, using reciprocal ram and piston means 30 attached at one corner of the blades 28. Each blade 28 has generally arcuate lower and upper front edges 34, cutaway 31 at different positions around the front edge. The blades 28 are moveable to move the edges 34 between (lowest) pack-edge overlapping positions, shown as "Position 1", and (lowest) pack-edge avoiding positions, shown as "Position 2".

Figures 5A, 5B, 5C, 5D:
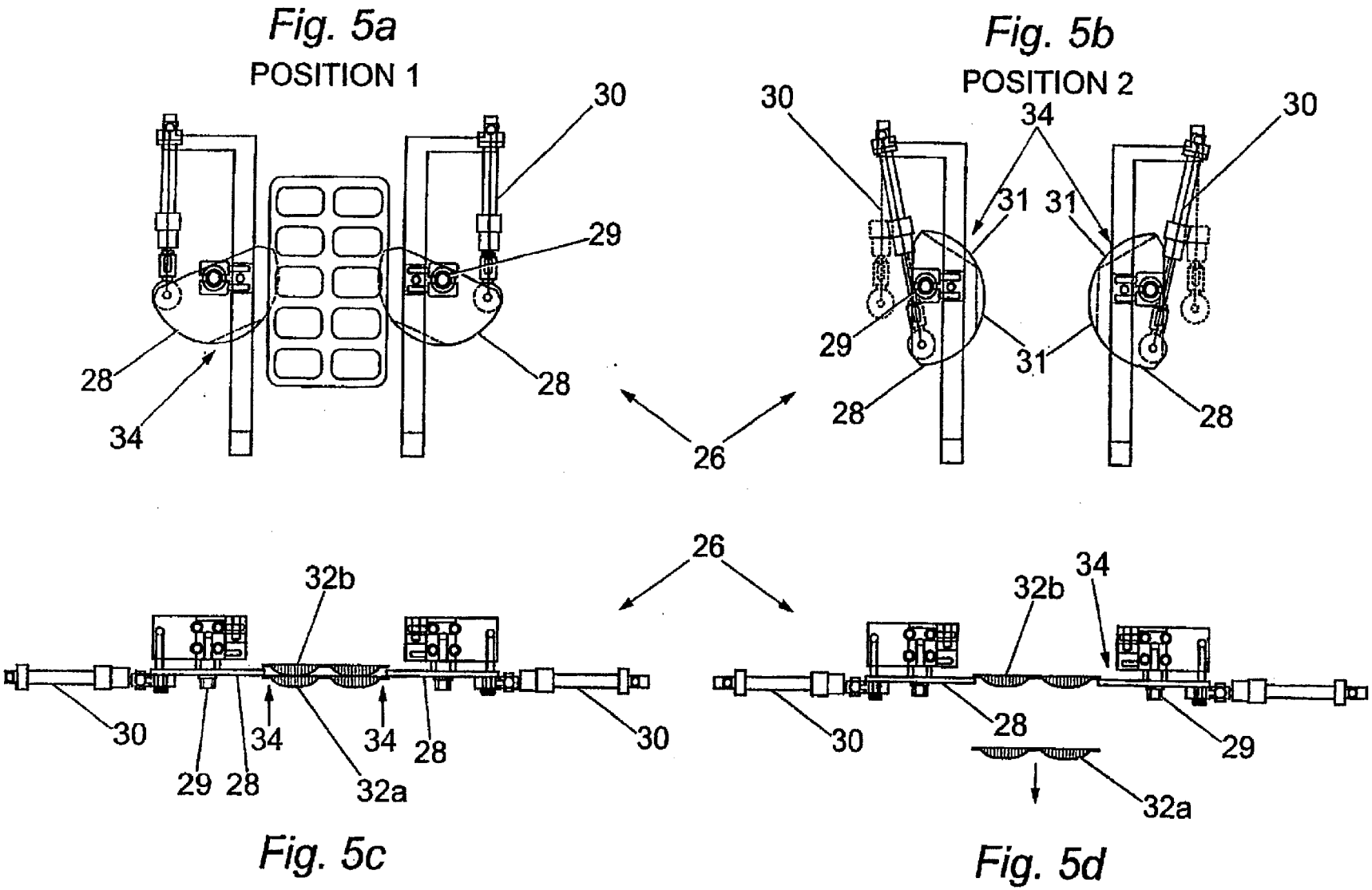
FIGS. 5*a* and 5*b* are plan views of a first pack selection means for use in the apparatus of FIG. 1.
FIGS. 5*c* and 5*d* are side views of the pack selection means in FIGS. 5*a* and 5*b* respectively.

FIG. 5*c* shows two stacked blister packs 32*a* and 32b (generally "32"). The edges of the lowest pack 32*a* are held by the lower edges of each blade 28 above which the upper edges are cutaway. By rotation of the blades 28 from Position 1 to Position 2, the lower edges are drawn away from the pack edges, so as to release lowest pack 32*a* to fall by gravity onto an aligned pack holding means 6 therebelow (not shown). Simultaneously, and as shown in FIG. 5*d*, the offset extended part of the upper edge of each blade 28 is rotated into an overlapping position underneath the pack edges of the next blister pack 32*b*. Reverse motion of the blades 28 allows the now-lowest pack 32*b* to be held by its pack edges by the lower extended edges of the blades 28, ready for loading into the next pack holding means 6 as it becomes available.

In use, blister packs 32 are fed into the magazine 27 to be loaded around the drum 2. Vacuum is applied to the pack holding means 6 when at the pack loading position A to assist loading of a pack 32 onto the relevant pack plate 8. The pockets 12 of the plate 8 accommodate the blisters of the pack 32. The drum 2 is then rotated 90° until the held pack 32 is aligned with the cutting position B. Where the pack 32 is a push through pack, no cutting may be necessary, such that the pack 32 is not acted upon at this stage. Where the pack 32 is a peelable pack, a cutting tool 36 can be directed against the backing of the pack 32 to wholly, or preferably substantially, cut the backing around each blister.

Meanwhile, a second pack 32 is loaded onto the following pack-holding means 6.

The drum 2 is then rotated 90° again until the first pack 32 is aligned with the pack deblistering position C. With continuing vacuum applied to the rear of each pack plate 8 as described above, the pack 32 is retained on the plate 8 even at position C.

At position C, a backing plate 38 is raised against the backing of the held pack 32. The backing plate 38 has apertures aligned with the blisters of the pack 32 and the pockets 12 of the pack plate 8. With the backing of the pack 32 thus firmly held between the plates 8, 38, the tablets can be forced out of the pack and collected below position C. The tablets could be pneumatically blown out. The backing plate 38 is then retracted.

Meanwhile, the following blister pack could be being out at position B, and a third pack loaded at position A.

With further 90° rotation of the drum 2, the empty pack 32 is ready for detachment at position D. Using a blast or pulse of air through the piping behind the pack plate 8 instead of vacuum, the empty pack is blown away from the drum 2. The discarded packs could be collected in a suitable bin.

Continuous rotation of the drum 2 clearly allows for continuous loading, optionally cutting, deblistering and detachment of similar blister packs.

Figure 7:
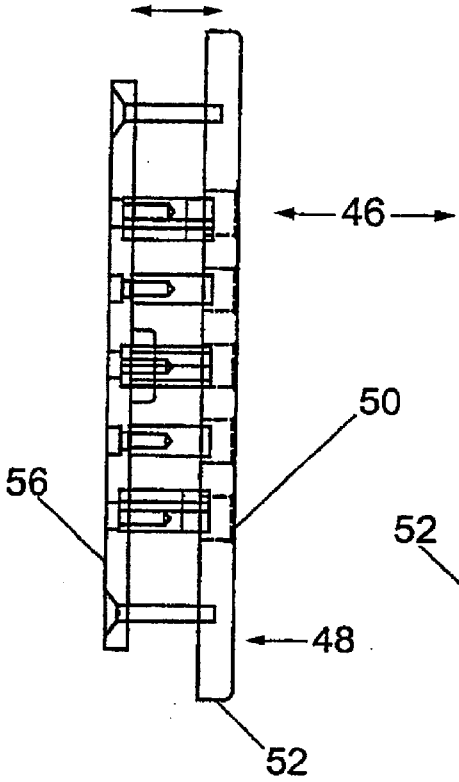
FIGS. 6, 7 and 8 show a top view and first and second cross-sectional side views of a second pack plate for use in the present invention.
Figure 6:
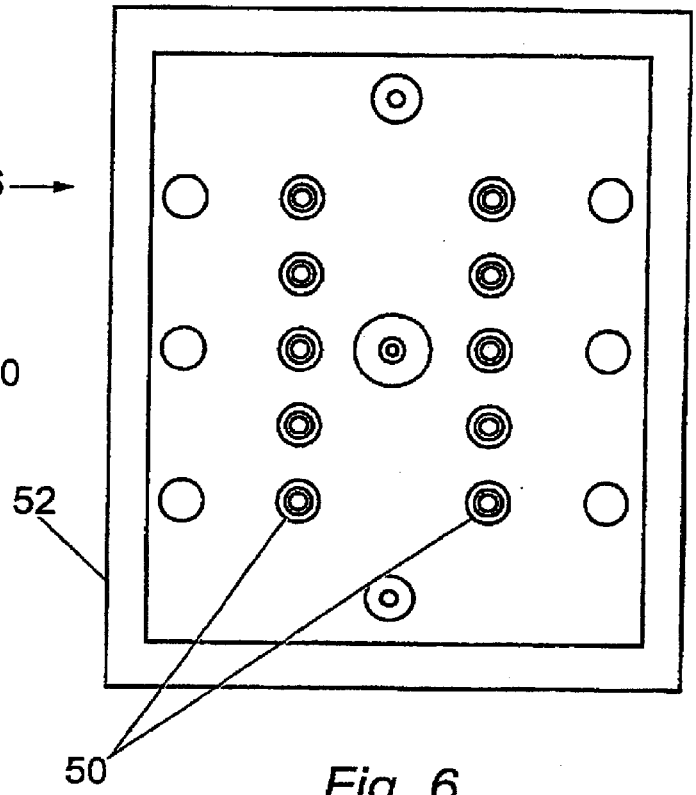
Figure 8:
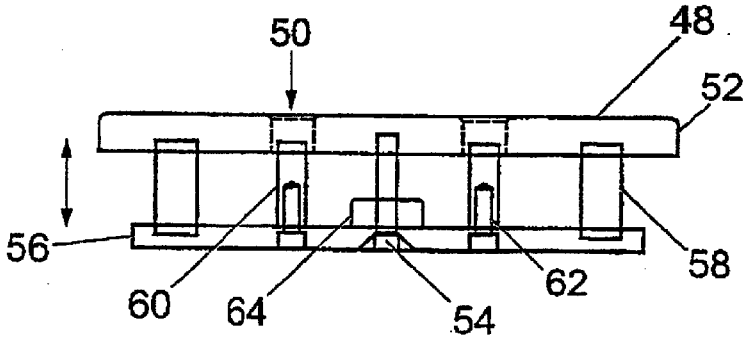

In one modified arrangement, second pack plates 46 as shown in FIGS. 6, 7 and 8 could be used. These pack plates 46 are similar to the first pack plates 8 described above, in that they have a smooth top surface 48, and a number of pockets 50 depending therefrom to suit the shape, number and configuration of the blisters on the blister pack or packs to be deblistered.

The top plate 52 of the second pack plate 46 fits with a pack holding means, eg the pack holding means 6 in FIG. 1 etc, to form a sealed enclosure, such that again vacuum can be used to retain the blister packs on the top plate 52 during the majority of the working cycle of the deblistering apparatus. The second pack plates 46 could be held in the pack holding means by simple catches or bolts etc.

Attached to the top plate 52 via a shoulder bolt 54 is a bottom plate 56, biased away from the top plate 52 by two intermediate springs 58. Upstanding from the bottom plate 56 are a series of eject pins 60 aligned with the pockets 50. The pins 60 are fixed to the bottom plate 56 by holding screws 62.

In use, the second pack plate 46 provides an alternative arrangement for ejecting the tablets from a blister pack, especially stronger eg. push through packs. When the blister pack has reached position C as shown in FIG. 1, a backing plate is still brought against the free side of the blister pack to firmly hold it as before. However, a mechanical force, eg. a hydraulic ram or piston, can now be used to impact the base of the bottom plate 56, and force it towards the top plate 52 of the second pack plate 46. In doing this, the pins 60 will travel up to and through the pockets 50, and mechanically push out the tablets from the held blister pack. A stop bar 64 limits the possible inter-plate distance.

This arrangement provides a usually stronger force of ejection, and possibly a more even force of ejection across all the pockets 50. The strength of each blister is therefore less important. There is also the potential with the ejection by air pressure that the bursting of any one blister will effectively nullify or weaken further air pressure action. Use of mechanical pins avoids this.

Figure 9:
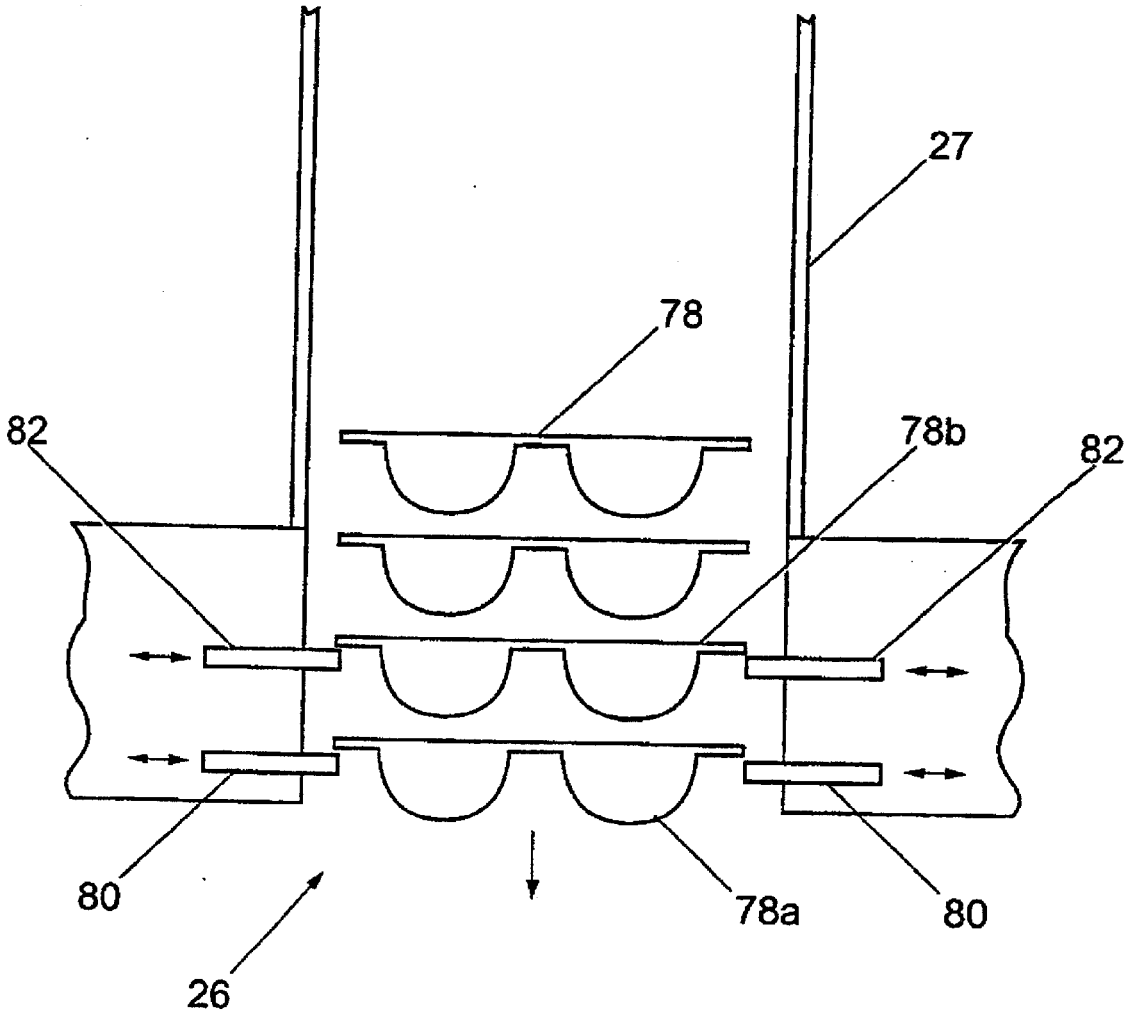
FIG. 9 is a side cross-sectional view of a second pack selection means for use in the apparatus of FIG. 1.

In a second possible modification to the apparatus, loading means as shown in FIG. 9 could be used. FIG. 9 shows four blister packs 78. The lowest pack 78*a* is held by two sets of lower pins 80 (one of each set is shown). Above these are two sets of upper pins 82, generally held (but not shown) in a retracted position. When the drum 2 has aligned a pack holding means 6 below the stack of blister packs 78, the upper pins 82 are extended (as shown) to hold the penultimate pack 78*b* (and thus all higher packs), whilst the lower pins 80 are retracted to allow the bottom pack 78*a* to fall by gravity onto the pack holding means 6. The lower pins 80 are then re-extended, and the upper pins 82 retracted, to allow the next pack 78*b* to be the next loadable pack.

The lower and upper pins 80, 82, like the blades 28 in FIGS. 5*a*–5*d*, have the added advantage that they are able to accommodate curled or otherwise non-flat blister packs by acting on the edges of a pack.

In a third possible modification of the apparatus, the mechanism for loading blister packs onto the apparatus at the pack loading position A could involve two or more helical screw or augers inclined towards the pack loading position. The substantially vertical screws are locatable on opposite sides of the blister packs, and converge towards the pack loading position, such that by rotation, the edges of the packs are met with the edges of the screws, and then guided downwards towards the pack loading position A. With the slight downward convergence of the screws, once the edges of the blister packs are located within the grooves of the screws, they will be continuously guided downwards towards the pack loading position A. The use of such screws may provide better and smoother catching of the edges of blister packs, and result in less rejection of misshaped blister packs, ie packs which may be curled or otherwise non-flat. The rotating screws also provide a continuous mechanism for regularly downloading the blister packs into the pack loading position A, without requiring separate or discrete pack loading operations.

The apparatus of the present invention as shown in FIG. 1 can be located with a box or cover 40, which could also be wholly or substantially sealed to minimize the possibility of contamination during the deblistering operation. FIG. 2 also shows the apparatus located on a mobile platform 42, making it easily relocatable. The motors and valves for the vacuum to the drum 2 and for the pneumatics for the operable work stations are located in a rear cabinet 44.

It is considered that the present invention could deblister fifty or more average peelable blister packs per minute, compared with the common maximum of twenty peelable packs per minute with batch or individualised prior art apparatus. The present invention can also deal with curled packs, which often block or jam prior art apparatus.

The present invention furthermore has the ability for tool-less changing of its plates to fit different sized, shaped or configured blister packs. Thus, the number of each type of pack to be deblistered, whether it be one or a thousand or more, makes little difference to the time required for deblistering.

The present invention also avoids the use of belts or chains to convey the blister packs between the work positions, decreasing the possibility of any contamination of the tablets from oil or grease etc.

We claim:

1. A rotary apparatus for deblistering a pharmaceutical blister pack having a number of product blisters, and having a substantially flat face, the apparatus comprising:

a rotatable drum having a plurality of circumferential pack holding means, each pack holding means having complementary pockets corresponding to the blisters of the blister pack, at least one aperture therethrough, and means to deblister the product from the pack;

a vacuum means to provide a vacuum pressure through the at least one aperture to positively position and hold steady the blister pack onto the pack holding means;

a pack loading means wholly or substantially above the drum to load the blister pack with the blisters face down onto the pack holding means; and means to rotate the drum to locate the pack holding means at a plurality of peripheral work positions including a pack loading position, a pack deblistering position, and a pack detachment position.

2. Apparatus as claimed in claim 1 wherein the rotational movement of the drum is indexed.

3. Apparatus as claimed in claim 1 wherein the drum is stationary at each work position.

4. Apparatus as claimed in claim 1 wherein the drum has the same number of pack holding means as work positions around the drum.

5. Apparatus as claimed in claim 1 wherein the drum is arranged to rotate about a horizontal axis.

6. Apparatus as claimed in claim 1 wherein at least one of the positions selected from the group consisting of the pack deblistering position and the pack detachment position is located wholly or substantially below the drum.

7. Apparatus as claimed in claim 1 wherein the pack loading means has a storage magazine able to supply a number of packs to the drum.

8. Apparatus as claimed in claim 1 wherein the loading means has a pack selection means to provide individual loading of each pack onto each pack-holding means.

9. Apparatus as claimed in claim 8 wherein the pack selection means comprises two opposing means moveable between pack-edge support positions and pack-edge release positions.

10. Apparatus as claimed in claim 1 wherein the pack holding means are adapted to match the shape, size and configuration of the design of the pack to be deblistered.

11. Apparatus as claimed in claim 1 wherein each pack holding means is changeable.

12. Apparatus as claimed in claim 1 wherein the pack deblistering position includes a force selected from the group consisting of mechanical, pneumatic, and combinations thereof, to deblister tablets from a pack held on the drum.

13. Apparatus as claimed in claim 1 wherein at least one of the positions selected from the group consisting of a pack weakening position and a pack cutting peripheral work position, is located before the pack deblistering position.

14. Apparatus as claimed in claim 1 wherein the pack holding means is moveable at one or more of the work positions.

15. Apparatus as claimed in claim 1 wherein at least a portion of the apparatus at one or more of the work positions is moveable when operating on a pack held on the drum.

16. A method of deblistering one or more blister packs using a rotary deblistering apparatus as claimed in any one of claims 1 to 15, wherein the pack is loaded onto a pack holding means at the pack loading position, rotated to the pack deblistering position where the tablets are forced out of the pack, and the empty pack is then rotated to the pack detachment position where the pack is detached from the pack holding means.

17. A method as claimed in claim 16 wherein the pack includes a backing and the backing of the pack is wholly or substantially cut or weakened at a further work position around the drum.

18. A method as claimed in claim 16 wherein deblistering of the tablets from a pack held on the drum is carried out using force selected from the group consisting of mechanical, pneumatic, and combinations thereof.

* * * * *